US010045601B2

(12) United States Patent
Endo et al.

(10) Patent No.: US 10,045,601 B2
(45) Date of Patent: Aug. 14, 2018

(54) ROTARY ADVANCING CONTAINER

(71) Applicant: MITSUBISHI PENCIL COMPANY, LIMITED, Tokyo (JP)

(72) Inventors: Mitsuru Endo, Gunma (JP); Satoru Sumiyoshi, Gunma (JP); Shoichi Saito, Gunma (JP); Tomoko Hasegawa, Gunma (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 15/165,140

(22) Filed: May 26, 2016

(65) Prior Publication Data

US 2016/0345709 A1 Dec. 1, 2016

(30) Foreign Application Priority Data

May 29, 2015 (JP) ..... 2015-109985

(51) Int. Cl.

| | |
|---|---|
| ***B43K 21/08*** | (2006.01) |
| ***A45D 40/04*** | (2006.01) |
| ***A45D 40/02*** | (2006.01) |
| ***A45D 40/06*** | (2006.01) |
| *A45D 40/20* | (2006.01) |

(52) U.S. Cl.

CPC ..... *A45D 40/04* (2013.01); *A45D 40/02* (2013.01); *A45D 40/06* (2013.01); *A45D 40/20* (2013.01); *A45D 2040/208* (2013.01)

(58) Field of Classification Search

CPC ..... A45D 40/02; A45D 40/04; A45D 40/06; A45D 2040/208; A45D 40/065

USPC ..... 401/68, 75

See application file for complete search history.

(56) References Cited

U.S. PATENT DOCUMENTS

| | | | | |
|---|---|---|---|---|
| 3,216,563 A * | 11/1965 | Finkenzeller | A45D 40/04 401/76 |
| 5,765,955 A * | 6/1998 | Tani | A45D 40/04 401/68 |
| 6,200,047 B1 * | 3/2001 | Holloway | A45D 40/04 401/68 |
| 6,331,084 B1 * | 12/2001 | Ohba | A45D 40/04 401/68 |

(Continued)

FOREIGN PATENT DOCUMENTS

| | | |
|---|---|---|
| JP | 2000-085861 A | 3/2000 |
| JP | 2003-310348 A | 11/2003 |
| JP | 2015-033460 A | 2/2015 |

*Primary Examiner* — Jennifer C Chiang

(74) *Attorney, Agent, or Firm* — Renner Otto Boissell & Sklar, LLP

(57) ABSTRACT

A rotary advancing container includes: a cylindrical front barrel; a cylindrical rear barrel arranged in a rear of the front barrel so as to be rotatable relative to the front barrel; a holding member inserted inside the front barrel or the rear barrel to support a stick-like member; and a threaded rod that is screwed into an interior part of the rear barrel. The stick-like member having a non-circular shape is moved in an axial direction relative to the front barrel by rotating the front barrel relative to the rear barrel, a front end of the threaded rod is formed in approximately the same shape with the rod-like member, and, a rear side portion of the threaded rod has a non-circular shape and is formed with a thread.

7 Claims, 14 Drawing Sheets

(56) References Cited

U.S. PATENT DOCUMENTS

| | | | | |
|---|---|---|---|---|
| 6,340,258 | B2 * | 1/2002 | Gueret | A45D 40/04 401/54 |
| 7,052,198 | B2 * | 5/2006 | Sasaki | A45D 40/04 401/55 |
| 7,128,486 | B2 * | 10/2006 | Ohba | A45D 40/04 401/88 |
| 7,284,926 | B2 * | 10/2007 | Tanaka | A45D 40/04 401/116 |
| 7,455,467 | B2 * | 11/2008 | Sasaki | A45D 40/04 401/68 |
| 7,736,079 | B2 * | 6/2010 | Tani | A45D 40/04 401/64 |
| 8,727,651 | B2 * | 5/2014 | Arai | B65D 83/0011 401/171 |

* cited by examiner

ROTARY ADVANCING CONTAINER

This Nonprovisional application claims priority under 35 U.S.C. § 119(a) on Patent Application No. 2015-109985 filed in Japan on 29 May 2015, the entire contents of which are hereby incorporated by reference.

BACKGROUND OF THE INVENTION (1) Field of the Invention

The present invention relates to rotary advancing containers that are used for stick type makeup containers, writing implements, applicators and the like that advance stick-like member such as stick-like makeup, stick-like writing element, stick-like applicator, etc., from a container.

(2) Description of the Prior Art

Conventionally, containers having a rotary advancing mechanism exemplified by the following Patent Documents 1 to 3 have been disclosed.

Patent Document 1 discloses a container that advances a solid stick-like makeup formed into an elliptic cylindrical core.

Patent Document 2 discloses a stick-like advancing tool for advancing an elliptic cylindrical core by means of a rotary advancing mechanism.

Patent Document 3 discloses a stick-like element advancing container that advances a solid stick cosmetic material by means of a rotary advancing mechanism.

PRIOR ART DOCUMENTS

Patent Documents

[Patent Document 1]
Japanese Patent Application Laid-open No. 2015-33460
[Patent Document 2]
Japanese Patent Application Laid-open No. 2000-35861.
[Patent Document 3]
Japanese Patent Application Laid-open No. 2003-310348

SUMMARY OF THE INVENTION

Problems to be Solved by the Invention

However, the above-described advancing mechanism of Patent Document 1 is a clicking type, which is different from the rotary advancing mechanism that is demanded herein. Patent Document 2 described above discloses a rotary advancing mechanism in which, however, a slider for advancing a stick-like cosmetic has a circular transverse cross-sectional structure. Patent document 3 discloses a configuration in which the pushing rod for advancing the stick-like cosmetic material has a non-circular transverse cross-section (see FIGS. 29 and 32). However, this configuration uses a solid stick-like cosmetic material, and is not one that is prepared by filling a material of the stick-like member into a stick-like advancing container and solidifying the material. That is, the stick-like advancing container of Patent Document 3 is not a sealed container.

The above advancing containers of Patent Documents 1 to 3 use many parts and need complicated assembly work, hence there have been demands for an advancing container that has a simple configuration and can be simply assembled, but no proposal has yet come true.

SUMMARY OF THE INVENTION

In view of the above circumstances, it is an object of the present invention to provide a rotary advancing container that can be simply assembled and still, has a highly sealed structure that can fill itself with a material to be advanced and accommodates the material therein.

Means for Solving the Problems

A rotary advancing container of the present invention includes:

a cylindrical front barrel;

a cylindrical rear barrel arranged in a rear of the front barrel to as to be rotatable relative to the front barrel;

a holding member inserted inside the front barrel or the rear barrel to support a stick-like member; and, a threaded rod that is screwed into an interior part of the rear barrel, wherein the stick-like member having a non-circular shape is moved in an axial direction relative to the front barrel by rotating the front barrel relative to the rear barrel, a front end of the threaded rod is formed in approximately the same shape with the rod-like member, and, a rear side portion of the threaded rod has a non-circular shape and is formed with a thread.

In the present invention it is preferable that the thread of the threaded rod has an approximately circular section with a flat part formed thereon.

In present invention it a preferable that the threaded rod is formed with a lightning hole in an interior of the rear end while the height of the thread in a rear side is lower than that of a front side.

In present invention it is preferable that the front barrel has a core loading part of an interior space, into which the stick-like member is loaded while an opening at a front end of the core loading part is formed so as to have a greater cross-section than that at a rear end of the core lording part.

In present invention it is preferable that the front barrel has a core loading part of an interior space, into which the stick-like member is loaded and a material is loaded into the core loading part to form the stick-like member in a state where the threaded rod and the holding member are retracted rearwards.

Advantages of the Invention

According to the rotary advancing container of the embodiment, it is possible to configure a rotary advancing container with a small number of components including the front barrel, rear barrel, holding member, stick-like member threaded rod and others. The threaded rod is screwed into the interior of the rear barrel, and the front end of the threaded rod has approximately the same shape with the stick-like member while the rear side portion of the thread rod is formed with a non-circular threaded shape. Loading the material into the interior space of the front barrel up to the holding member makes it possible to create the stick-like member. As the rear barrel is turned relative to the front, barrel, the stick-like member can be advanced by the above described simple structure.

DESCRIPTION OF THE PREFERRED EMBODIMENTS

Figure 1A:
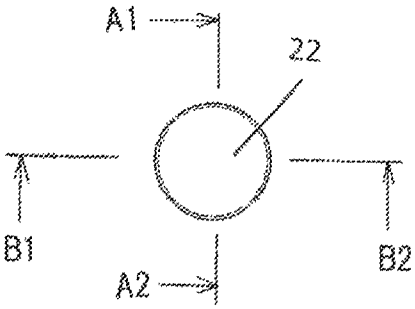
FIGS. 1*a* to 1*c* are illustrative diagrams showing a state of a rotary advancing container according to an embodiment of the present invention, with its cap fitted in place, FIG. 1*a* a view from the front, FIG. 1*b* an external view, FIG. 1*c* a vertical section cut across a plane A1-A2 in FIG. 1*a* and FIG. 1*d* a vertical section cut across a plane B1-B2 in FIG. 1*a*, which is rotated 90° from FIG. 1*c*.
Figure 1B:
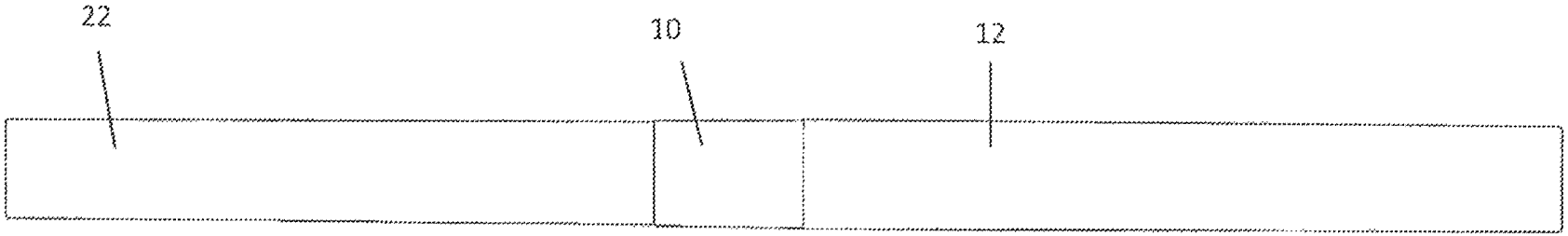
Figure 1C:
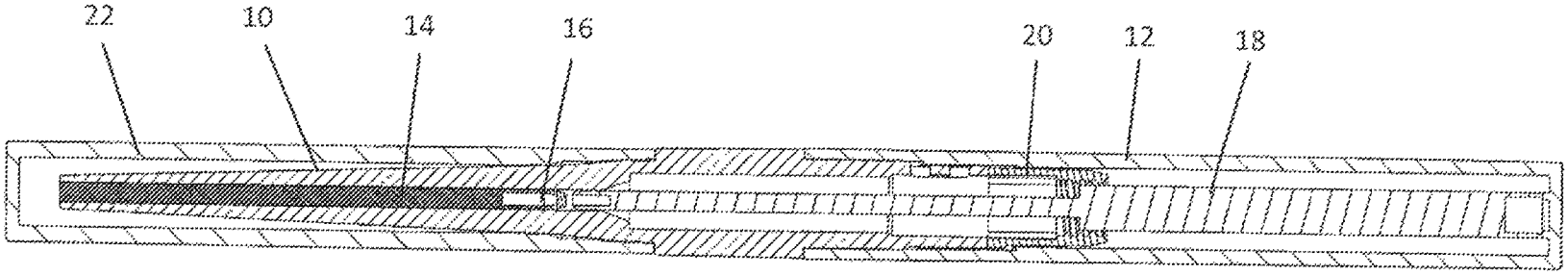

Now, the embodiment of the present invention will, be described with reference to the accompanying drawings.

FIG. 1 is an illustrative diagram showing a state of a rotary advancing container according to one embodiment, with its cap fitted in place, FIG. 2 is an illustrative diagram showing an uncapped state of the rotary advancing container, and FIGS. 3 to 8 are illustrative diagrams of individual, parts. FIG. 9 is an illustrative diagram of the rotary advancing container after use.

As shown in FIGS. 1 and 2, the rotary advancing container according to the embodiment contains: a cylindrical front barrel 10: a cylindrical rear barrel 12 rotatably arranged in the rear of the front barrel relative to the front barrel 10; and a holding member 16 inserted inside the front barrel 10 or the rear barrel 12 for supporting a stick-like member 14. The rotary advancing container is configured to move the stick-like member 14 having a non-circular transverse cross-section, in the axial direction relative to the front barrel 10 by turning the front barrel 10 relative to the rear barrel 12. The rotary advancing container further includes a threaded rod 18 that is screwed into the inside of the rear barrel 12 (a threaded piece 20 integrally rotating with the rear barrel 12). The front end of the threaded rod 18 is formed to have substantially the same shape wish the stick-like member (core) 14 while the rear part is formed with a thread part 18*b* (FIG. 6) having a non-circular transverse cross-section. Designated at 22 is a cap.

The rotary advancing container according to the embodiment is composed of seven parts, i.e., a cap 22, front barrel 10, a core (elliptic) of the stick-like member 14, holding member (pistons 16, threaded rod 18, threaded piece 20 and rear barrel 12. Each part will be described.

[Cap 22]

The cap 22 is given, in the form of a cylindrical body, closed in the front and open on the rear side as shown in FIG. 3. When the rotary advancing container is not used, the front barrel 10 can be capped or enclosed by the cylindrical cap 22 as shown in FIG. 1. When the rotary advancing container is used, the cap is removed from the front barrel 10 so that the front barrel 10 is exposed as shown in FIG. 2. In this state, the stick-like member 14 is advanced and exposed from the front end of the front barrel 10. An annular projection 22*a* to be engaged with the front barrel 10 (projection 10*b*); is formed on the inner periphery in the rear part of the cap 22 (FIG. 3*d*).

[Front Barrel 10]

Figure 4C:
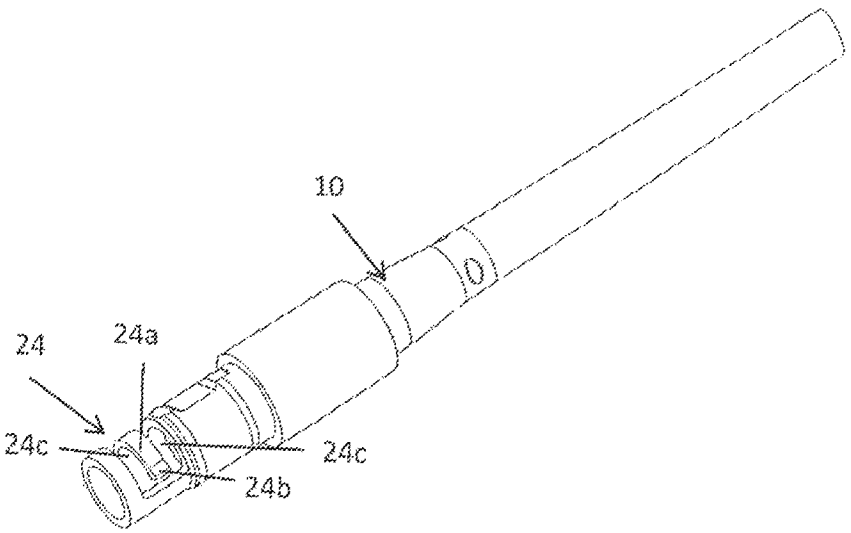
FIGS. 4*a* to 4*g* are illustrative diagrams showing a front barrel as a part of the rotary advancing container shown in FIG. 1, FIG. 4*a* a perspective view from the front, FIG. 4*b* a view from the front, FIG. 4*c* a perspective view from the rear, FIG. 4*d* a plan view, FIG. 4*s* a front view, FIG. 4*f* a vertical section cut across a plane F1-F2 in FIG. 4*d* and FIG. 4*g* a view from the rear.
Figure 4A:
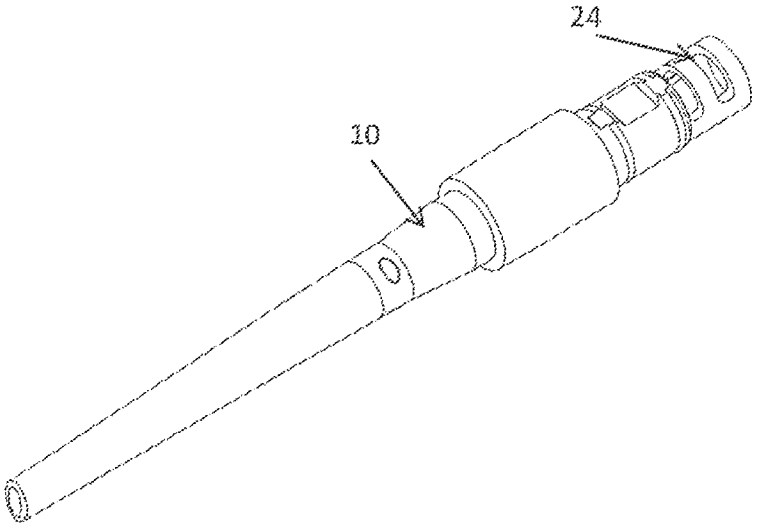
Figure 4G:
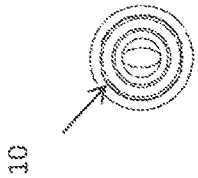
Figure 4D:
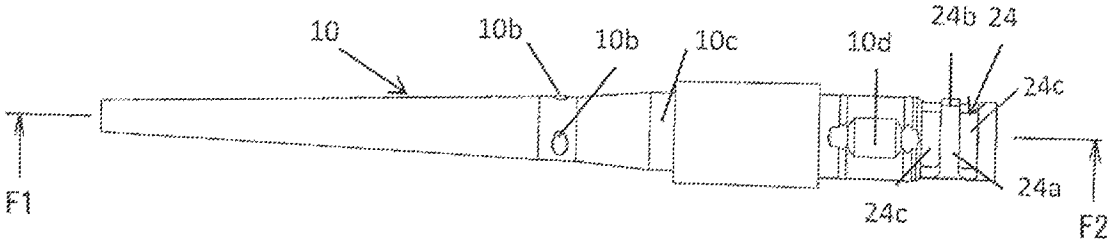
Figure 4E:
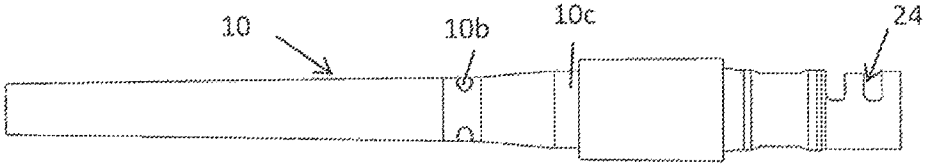
Figure 4F:
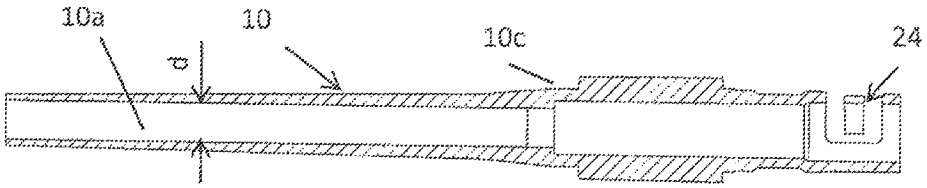
Figure 4B:
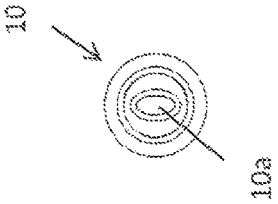

Formed inside front barrel 10 is a loading passage (corresponding to the core loading part) 10*a* having a transverse cross-section elliptic shape for the stick-like member 14, as shown in FIG. 4*b*. This loading passage 10*a* is configured to have an opening, facing toward the front, at front end and penetrate from the front opening up to the middle of the front barrel 10 (FIG. 4*f*).

The loading passage 10*a* as the core loading part in the front barrel 10 is preferably formed such that the transverse cross seer: on of the front end opening is wider than the transverse cross section at the rear end opening.

The rear half from the middle of the front barrel 10 is formed with a passage extending from the loading passage 10*a* to the rear opening. Formed on the peripheral wall of the rear end portion is a ratchet part 24, which intermittently engages (meshes; with a plurality of longitudinal ribs 12*a* (FIGS. 5*c* to 5*e*) in the interior of the rear barrel 12 shown in FIG. 5 with a click and the like as the rear barrel 12 is turned relative to the front barrel 10.

The ratchet part 24 has a plurality of slits 24*c*, 24*c* cut in the rear portion of front barrel 10 so as to form a cantilevered flexible finger (repulsive part) 24*a* between the slits 24*c* and 24*c* (FIGS. 4*c* and 4*d*). Following rotational movement, finger 24*a* as the repulsive part slides up and over the aforementioned plurality of longitudinal ribs (serration) 12*a* formed in the interior of the rear barrel.

In the ratchet part 24, the cantilevered finger 24*a* is defined by the hollowed portions in the peripheral wall (the plurality of slits 24*c*, 24*c*), and formed at its distal end with a wedge-like or triangular prism-like projecting portion 24*b*.

The stick-like member 14 is adapted to move forwards by 0.01 to 0.2 mm as the finger 24*a* slides up and over one of the plurality of teeth of the serration formed inside the rear barrel 12. Thus, the stick-like member 14 such as a makeup material or the like can be advanced little by little.

The loading passage 10*a* of the front barrel 10 is formed in an elliptic shape when viewed from the front as shown in FIG. 4*b* and has the same shape continuously extended from the front end to the middle part. As shown in FIG. 4*a* the outer peripheral side of the front barrel 10 is gently tapered, that is, the front barrel 10 is formed to foe gradually greater in diameter from the front end toward the middle part. Formed in the middle part on the outer peripheral side are three projections 10*b* for catching the cap 22, arranged at an angle of 120° apart from each other (FIGS. 4*d* and 4*e*).

The outer peripheral of the middle part of the front barrel 10 has a cylindrical shape with its front part stepped down in diameter, forming an airtight portion 10*c*. The airtight portion 10*c* is externally fitted by a sealing portion 22*b* (FIG. 3*d*) of the cap 22, creating an airtight structure. A gate 10*d* (FIG. 4*d*) through which resin for injection molding is poured is formed in the outer side in front of the ratchet part 24.

[Rear Barrel 12]

Figure 1D:
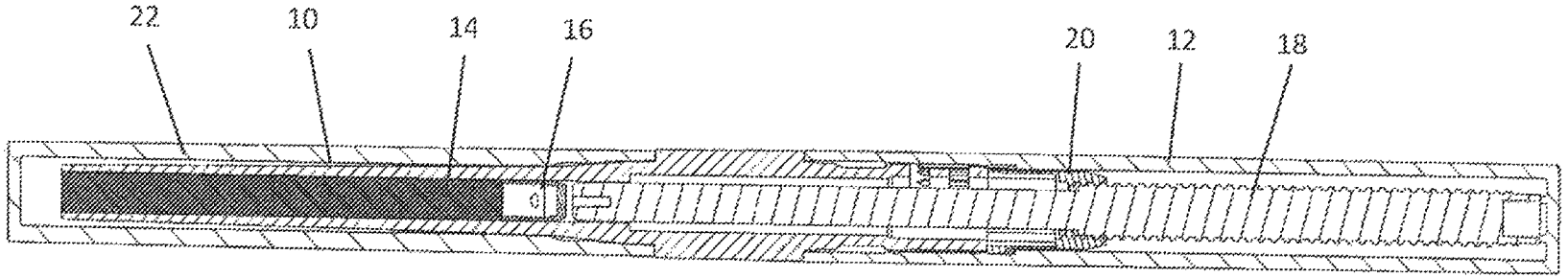
Figure 2A:
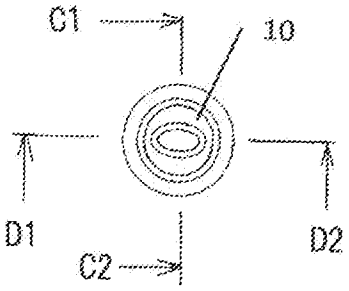
FIGS. 2*a* to 2*d* are illustrative diagrams showing an uncapped state of the rotary advancing container shown in FIG. 1, FIG. 2*a* a view from the front, FIG. 2*b* an external view, FIG. 2*c* a vertical section cut across a plane C1-C2 in FIG. 2*a* and FIG. 2*d* a vertical section cut across a plane D1-D2 in FIG. 2*a*, which is rotated 90° from FIG. 2*c*.
Figure 2B:
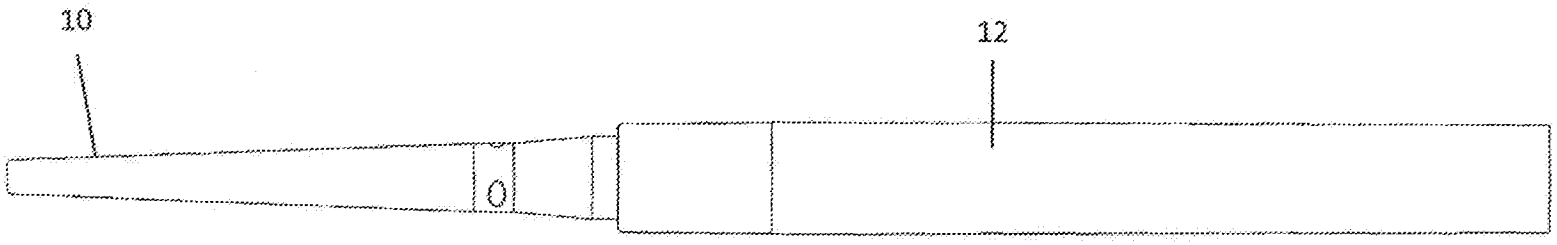
Figure 2C:
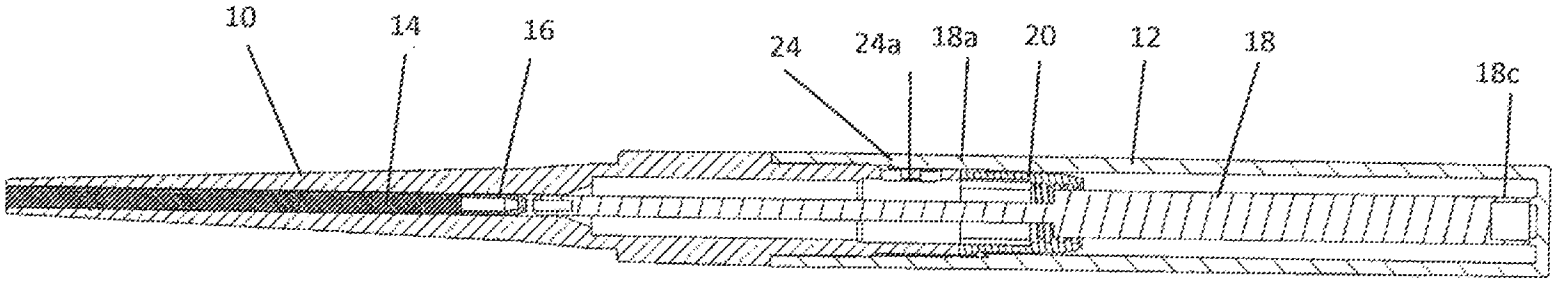
Figure 2D:
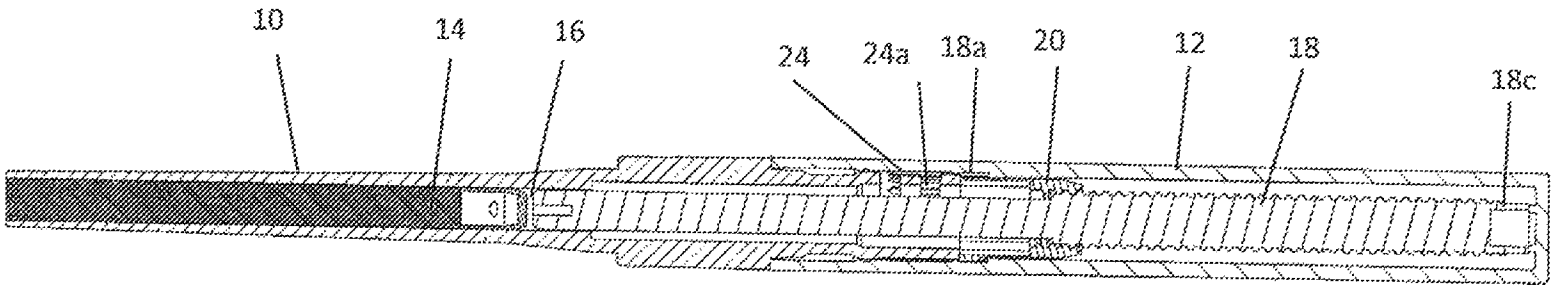
Figure 3E:
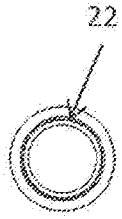
FIGS. 3*a* to 3*e* are illustrative diagrams showing a cap as a part of the rotary advancing container shown in FIG. 1*f* FIG. 3*a* a view from the front (the left side view) FIG. 3*b* a perspective view, FIG. 3*c* a front view, FIG. 3*d* a vertical section cut across a plane E1-E2 in FIG. 3*c* and FIG. 3*e* a view from the rear (the right side view).
Figure 3B:
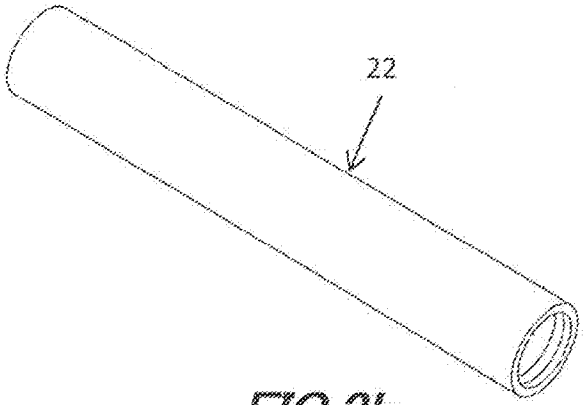
Figure 3C:
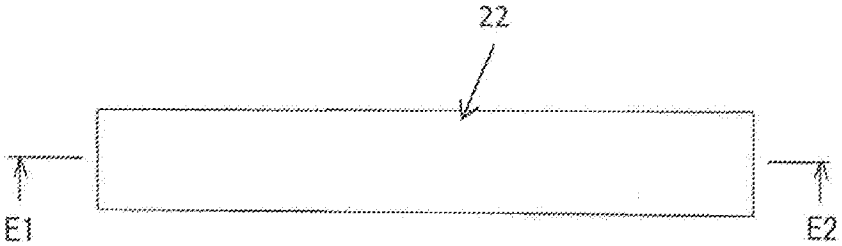
Figure 3D:
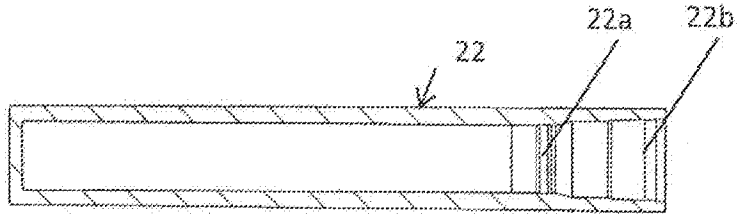
Figure 3A:
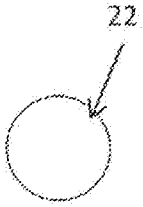
Figure 5B:
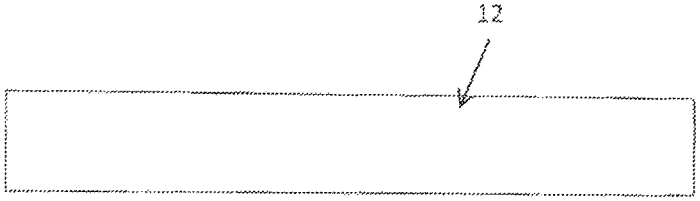
FIGS. 5*a* to 5*e* are illustrative diagrams showing a rear barrel as a part of the rotary advancing container shown in FIG. 1, FIG. 5*a* a view from the front, FIG. 5*b* a front view, FIG. 5*c* a vertical section of FIG. 5*b*, FIG. 5*d* a sectional view cut across a plane G1-G2 in FIG. 5*c* and FIG. 1*e* an enlarged view of the encircled part B in FIG. 5*c*.
Figure 5C:
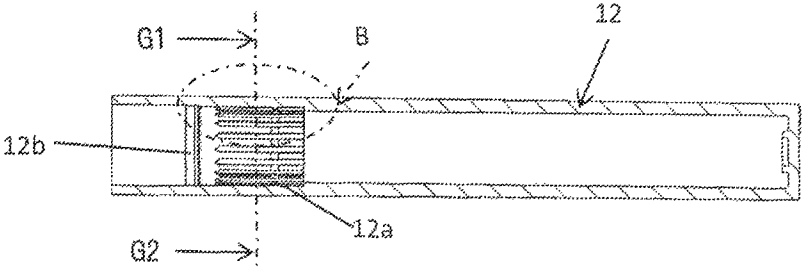
Figure 5E:
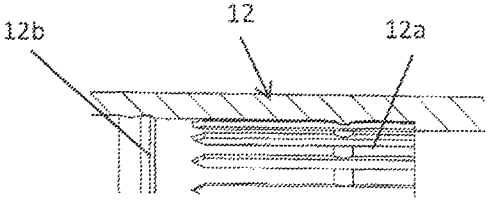
Figure 5A:
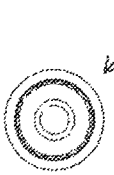
Figure 5D:
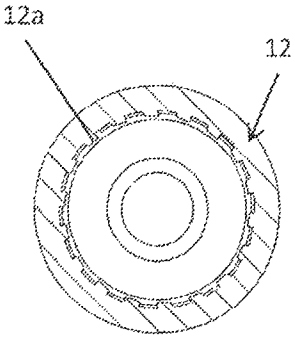

Rear barrel 12 is a cylinder with its rear end closed as shown in FIG. 5*c*. Formed in the interior peripheral surface on the front-end side of rear barrel 12 are the aforementioned longitudinal ribs 12*a*. The threaded piece 20 is inserted in the rear side of the longitudinal, ribs 12*a* in an unrotatable manner (FIGS. 1*e* and 1*d*). The aforementioned ratchet part 24 (FIGS. 4*c* to 4*f*) is arranged in abutment with the front side of the threaded piece 20.

Further, a fitting portion 12*b* (FIGS. 5*c* and 5*e*) for rotatably preventing the outer periphery of the front barrel 10 from detaching from the rear barrel 12 is formed on the front side of the longitudinal ribs 12*a* of the rear barrel 12.

[Threaded Rod 18]

As shown in FIG. 6, the front part of the threaded rod 18 has an elliptic transverse cross section, forming a pushing part 18*a* having a flat outer peripheral side. A hollow portion is formed in the front one race of the threaded rod 18 (FIGS. 6*e* and 6*g*). The outer peripheral of the rear part of the threaded rod 18 is formed with a male thread, forming a thread part 18*b* (FIGS. 6*a*, 6*c* to 6*g*). The thread part 18*b* has an approximately circular transverse cross-section with a pair of linear flat surfaces 18*b*1 formed along with the direction to which the axis line extends.

Figure 6C:
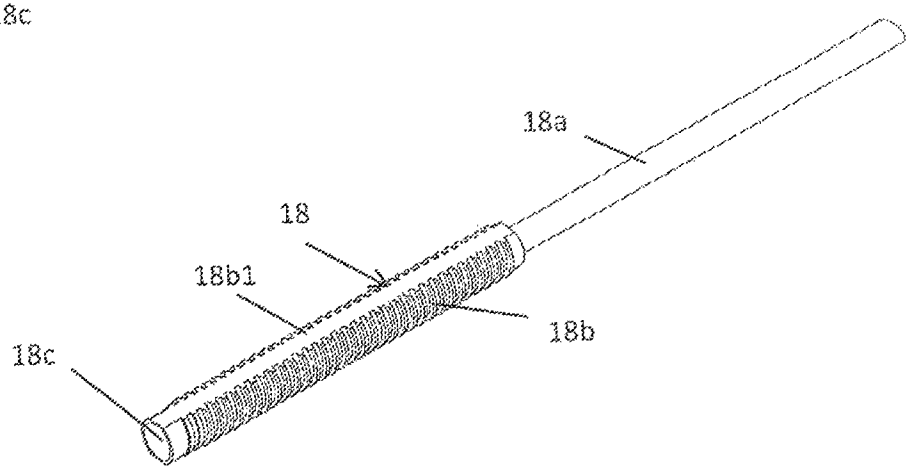
FIGS. 6*a* to 6*h* are illustrative diagrams showing a threaded rod as a part of the rotary advancing container shown in FIG. 1, FIG. 6*a* a perspective view from the front, FIG. 6*b* a view from the front, FIG. 6*c* a perspective view from the rear, FIG. 6*d* a plan view, FIG. 6*e* a vertical section cut across a plane H1-H2 in FIG. 6*b*, FIG. 6*f* a front view, FIG. 6*g* a vertical section cut across a plane I1-I2 in FIG. 6*b* and FIG. 6*h* a view from the rear.
Figure 6A:
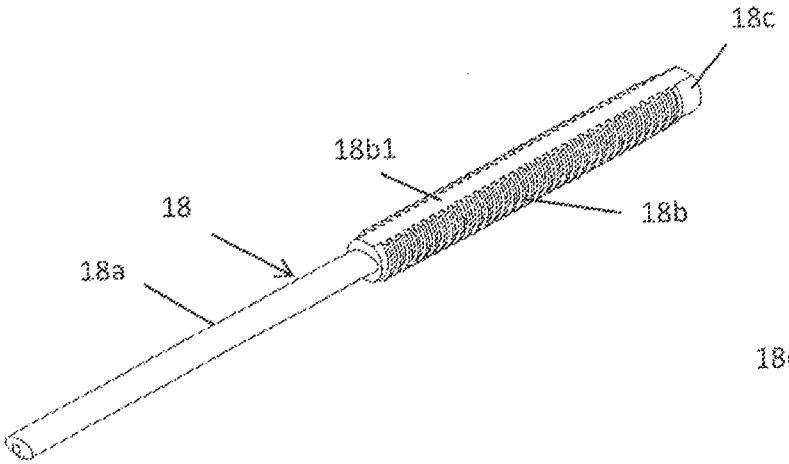
Figure 6D:
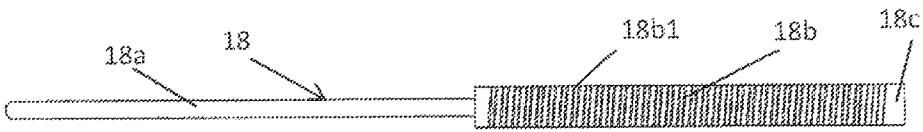
Figure 6E:
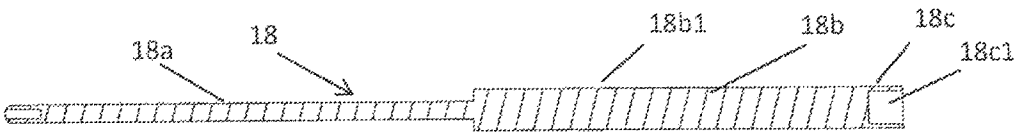
Figure 6F:
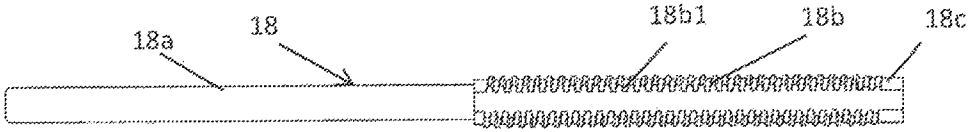
Figure 6G:
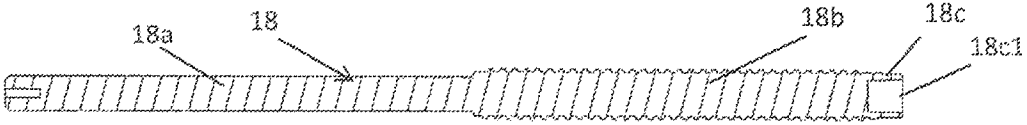
Figure 6H:
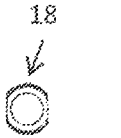
Figure 6B:
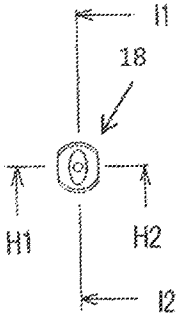

The threaded rod 18 is formed so that the depth of the thread is lowered from the front end toward the rear end (rear end portion 18*c*) of thread part 18*b*, and has a lightening hole 18*c*1 recessed inward from the rear end face (FIG. 6*e*).

[Threaded Piece 20]

The threaded piece 20 (FIGS. 1*c* and 1*d*) has an approximately cylindrical shape with a plurality of whirl-docking ribs 20*a* formed on the outer periphery in the front end and a female thread 20*b* formed in the inner peripheral surface in the rear end, as shown in FIGS. 7*a* to 7*g*.

[Holding Member 16]

The holding member (piston) 16 (FIGS. 1*c* and 1*d*) is to fix the stick-like member (core) 14 to the front end of threaded rod 18. As shown in FIG. 8, the holding member 16 is an approximately cup-like form or a tubular form having an elliptic transverse cross-section with its rear end closed.

The holding member 16 has an interior space into which stick-like member (core) 14 can be loaded from the front side. A projection 16*a* is formed inside the holding member 16 so as to prevent the stick-like member 14 from falling out.

The rear end face 16*b* of the holding member 16 forms a flat abutment face, against which the front end of the threaded rod 18 simply abuts. That is, this arrangement creates such a structure that when the holding member 16 is pressed by the threaded rod 18, the holding member 16 moves forward but the holding member 16 will not move backwards if the threaded rod 18 is retracted.

Further formed along the rim of the opening end of the holding member 16 is a flange-like outer peripheral sealing part 16*c* that slides in hermetic contact with the inner peripheral surface of the front barrel 10. This arrangement makes it possible to stably advance the stick-like member 24 keeping air-tight without causing any backlash.

Further, the holding member 16 is formed so that, the outside diameter of the above-described outer peripheral sealing pare 16*c* is specified at a dimension d1 (FIG. 8*e*) marginally greater than the inside diameter d (see FIG. 4*f*) of the front barrel 10 (the loading passage 10*a*).

When a paste or liquid cosmetic material is loaded into the loading passage 10*a* in order to form a stick-like member (solid cosmetic), the outer peripheral sealing part 16*c* comes into hermetic contact with the inner surface of the front barrel 10 so that the material will not leak rearwards from the outer peripheral sealing part 16*c*. Besides, when the solid cosmetic, or the solidified cosmetic material is advanced, it is possible to positively advance the material. The seal-tightening margin (d1−d) is preferably 0.05 to 0.25 mm. If the margin is less than 0.05 mm, stable sealing performance cannot be assured, whereas a Lightening margin in excess of 0.25 mm imposes too much turning force (torque) when the solid cosmetic is advanced, making it impossible to provide conformable operatively.

Though the holding member 16 is configured to be inserted into the front barrel 10 (FIGS. 1*c* and 1*d*), it is possible to provide a configuration in which the holding member is inserted into the rear barrel 12.

The operation and functions of the rotary advancing container according to the embodiment will be described.

This rotary advancing container is used with its cap 22 removed as shown in FIG. 2, and configured to advance a fixed amount of Stick-like member (core) 14 having an elliptic transverse cross-section by turning the rear barrel 12 relative to the front barrel 10.

In the turning operation of the rear barrel 12, the user feels a clicking sensation as turning the rear barrel in a circumferential direction and can advance the loaded core or stick-like member 14 by a very small distance as short as 0.01 to 0.2 (preferably about 0.05) mm as one click action is performed.

One revolution of the rear barrel by the turning operation makes the stick-like member 14 advance by 0.5 to 1.5 mm.

The stick-like member 14 (leading core) is loaded inside space from the front opening of the front barrel 10 to the holding member (piston) 16 in hermetic contact with to the interior surface of the front barrel 10. This stick-like member 14 contains volatile components. In this case, the composition of the core of the stick-like member 14 contains powder components in an amount of 60 to 90% by weight, acrylate silicone, silicone-based solvents and wax components, and characterized in that the powder components consist of pigments and extender materials.

The preferred pigments to be used are, in particular, planar pigments to produce shiny texture for makeup. Examples of planar pigments include titanated mica, carmine-coated titanated mica, chromium oxide-coated titanated mica, iron oxide-coated titanated mica, iron oxide/carmine-coated titanated mica, iron oxide/iron blue-coated titanated mica, blue-coating titanated mica, iron blue-coated titanated mica, red iron oxide-coated mica, red iron oxide-coated titanated mica, red iron oxide/carmine-coated titanated mica, red iron oxide/iron oxide-coated titanated mica, red iron oxide/iron blue-coated titanated mica, red iron oxide/iron oxide/iron blue-coated titanated mica and others, or shiny pigments made of glass flakes or bulk flakes as a base material, being coated by a metal or metal oxide. Of these, at least one kind (alone or a mixture of two or more materials; the same applies hereinbelow) is used.

Preferably, in view of coating uniformity and application performance, iron oxide-coated titanated mica, titanated mica, blue-coated titanated mica can be mentioned, especially, iron oxide-coated titanated mica and titanated mica are preferably used. It is more preferable that these planar pigments that have been lipophilically treated are used. The lipophilic treatment is preferably performed using lauroyl lysine or the like.

These planar pigments preferably have a size of 5 to 20 μm. Here in the present invention (including the embodiments described below), the mean particle size should be defined by averaging the major diameters of the particles in the planar direction, by observing the particles by optical or electron microscope.

Generally, excessive amounts of the planar pigments could cause reduction in strength, deterioration of application performance and uncomfortable feeling of use. However, the inventors hereof have overcome the above-described performance degradation by developing the techniques as described in the above prior art document 1, and found that the content of the pigments in an amount of 10 to 50% by mass (which will be simply referred to hereinbelow as %) relative to the total amount of the stick-like member 14 is preferable to obtain favorite strength, application performance and use properties.

A content of the planar pigments less than 10% cannot produce preferable application performance in shading over eyebrows, whereas the content of she pigments is preferably specified at 50% or lower in view of use performance and (line) application performance on the skin.

It is also possible to use pigments other than the planar pigments. Examples of usable pigments include titanium oxide, iron black, carbon black, iron blue, lapis lazuli, pigment blue 1 (e.g. brilliant blue FCF), red iron oxide, yellow iron oxide, chromium oxide, chromium hydroxide, zinc oxide, zirconium oxide, cobalt oxide, fish scale flake, bismuth oxychloride, pigment blue 2 (e.g. indigo carmine), pigment blue 404 (e.g. phthalocyanine blue), pigment red 201 (e.g. lithol rubine B), pigment red 202 (e.g. lithol rubine BCA), pigment red 220 (e.g. deep maroon), pigment red 102 (e.g. new coccine), pigment red 104 (e.g. phloxine), pigment yellow 4 (e.g. tartrazine), pigment yellow 4Al lake (e.g. tartrazine aluminum lake) and other pigments, and aluminum coated polyester film. Of these, at least one hind can be used.

The range of the content of the pigments except the planar pigments is specified appropriately within the range of the total amount of the pigments in question, the planar pigments and the extender material.

The extender material used for the stick-like member 14 should not be particularly limited. Any material can be used for the extender material as long as it is used for the conventional stick-like members. For example, white extender materials such as spherical resin particles, boron nitride, kaolin, talc, calcium carbonate, sericite, zinc oxide, hydroxyapatite can be used for the extender material. Also, depending on the hue of the stick-like member, colored extender materials may be used for the extender material. Of course, mixtures of some materials of these can also be used for the extender material. Particularly preferably, because of the advantage of physical properties and configurations, the spherical resin particle namely at least one kind selected from silicone rubber powder, nylon powder or the like, can be used.

The total content of the extender materials, the planar pigments and the pigments is preferably specified to be 60 to 90% relative to the total amount of the stick-like member 14.

If the total content of the extender materials, the planar pigments and the pigments is less than 60%, it is impossible to provide good application performance of shading lines over the eyebrow. On the other hand, if the total content exceeds 90%, the resultant stick-like member is too weak and too brittle to be tolerable to practical use, hence unpreferable.

The wax components used in the present invention are not particularly limited as long as they are hydrocarbon-based waxes containing carbon material of 26 to 33. For example, at least one of hydrocarbon waxes, Ceresin wax, polyethylene warn, paraffin wax, candelilla wax, jojoba wax, carnauba wax, synthetic waxes, fatty acid triglycerides and others can be mentioned.

In view of application performance and producing a shiny appearance, hydrocarbon waxes can be preferably used.

The content of wax components is preferably specified to be 0.5 to 10% relative to the total amount of the stick-like member 14.

When the content of wax components is less than 0.5%, it is difficult to provide firmness of the stick-like member 14 as a core. On the other hand, in excess of 10%, the resultant stick-like member becomes too hard to be used for application, hence unpreferable.

Examples of usable silicone-based solvents include diphenyl siloxy phenyl trimethicone, decamethylcyclopentasiloxane, octamethylcyclotetrasiloxane, methyl trimethicone, dimethicone, dodecane and isododecane.

The content of the volatile components is preferably specified to be 10 to 25% relative to the total amount of the solid stick-like cosmetic material, in view of use properties and long-lasting performance.

Examples of usable gelling agents include tri (behenate, isostearate, eicosadionate) glyceryls.

The content of gelling agents is preferably specified to be 0.5 to 2.0% relative to the total amount of the solid stick-like cosmetic material.

Fixing resin components are also used to function as trim-forming agents. Examples of usable curing resin include trimethyl siloxysilicate, acrylate silicone and stearyl-modified acrylate silicone, in view of curing performance and application performance, acrylate silicone is preferable. The total content of the curing resin components is preferably 1 to 10%, more preferably 3 to 8% relative to the total amount of the stick-like member 14.

Usable oil components are not particularly limited. Examples include diisostearyl malate, triethylhexanoin, neopentyl glycol dimethylhexanoate, sunflower oil, and castor oil, squalene and the like.

The total content of oil components is preferably specified to be 2 to 10% relative to the total amount of the stick-like member 14 in view of use performance and providing smooth application feeling.

Other than the above, stick-like member 14 preferably includes silicone-based solvents, gelling agents, curing resin components, oil components. It is also possible to contain optional components generally used for solid-type stick-like cosmetics, such as antioxidants, beauty ingredients and aromatics, specifically, antiseptics, antioxidants, UV absorbing agents, chelating agents, moisturizing agents, vitamin E (dl-α-tocopherol acetate), in appropriate amounts.

The loading core as stick-like member 14 is accommodated in one of the rotary advancing containers of the present embodiment, and can apply, without, having restriction of the usage, to solid makeup products such as makeup eyebrow, eyeliner, lip liner cosmetics, writing implements such as color pencils, pencils, and quasi-drugs aiming at moisturizing corners of the mouth and lips. The shape of the core is not limited to the configuration having an elliptic transverse cross-section. The cross-section may be formed in a non-circular shape such as triangle, rectangle/square, polygon and the like. The configuration of stick-like member 14 can provide a rotary advancing container for storing cosmetics that makes the mechanical strength such as breakdown strength fall within the practical range and is excellent in uniformity and adhesion of the coated film and excellent in application properties and aging stability, especially the aging stability at high, temperatures. Further, pigments including planar pigments are subjected to lipophilic treatment and kneaded and molded together with the extender material and other materials than the above powders, whereby it is possible to provide stick-like member 14 that is improved in the above characteristics.

(1) The clicking feeling when the rear barrel 12 is turned relative to the front barrel 10 can be produced by the ratchet part 24 as follows.

Specifically, as shown in FIG. 2 in the rotatory advancing container, the finger 24*a* of a cantilevered structure is arranged at the rear end of the front barrel 10 (on the rear barrel 12 assembly side) so as to flex in a circumferential direction while the inner peripheral side of the rear barrel 12 is formed with equiangularly arranged the plurality (e.g., eighteen) of longitudinal ribs 12*a*, whereby this configuration produces clicking feeling. In this case, the clicking feeling is generated by the tip edge 24*b* (FIGS. 4*c* and 4*d*) of the finger 24*a* sliding up and over the ridge of the longitudinal rib 12*a* (FIGS. 5*c* to 5*a*) and stepping down to the groove (the height difference between the ridge and the groove is 0.2 mm). The rotation of the rear barrel 12 relative to the front barrel 10 is allowed in a forward direction and restricted in the reverse direction. Accordingly, the loading core of the stick-like member 14 once advanced cannot be returned.

Figure 7A:
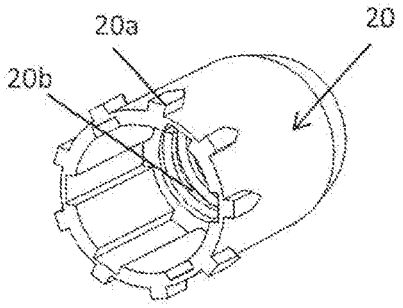
FIGS. 7*a* to 7*g* are illustrative diagrams showing a threaded piece as a part of the rotary advancing container shown in FIG. 1, FIG. 7*a* a perspective view from the front, FIG. 7*b* a view from the front, FIG. 7*c* a front view, FIG. 7*d* a front view, FIG. 7*e* a vertical section cut across a plane J1-J2 in FIG. 7*c*, FIG. 7*f* a perspective view from the rear and FIG. 7*g* a view from the rear.
Figure 7C:
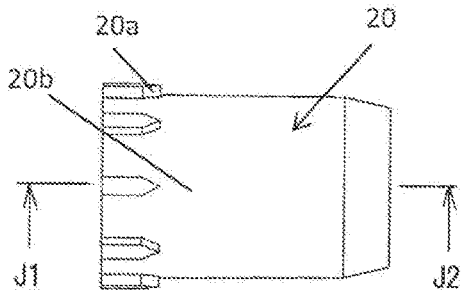
Figure 7B:
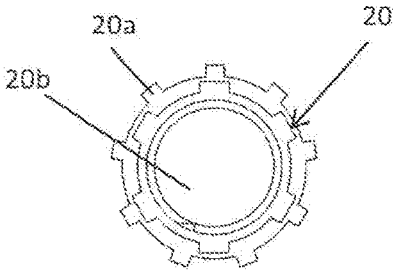
Figure 7D:
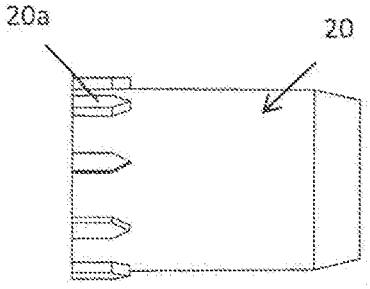
Figure 7E:
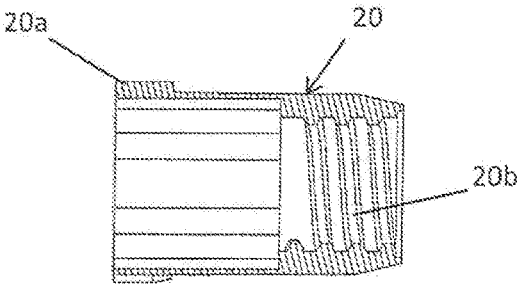
Figure 7F:
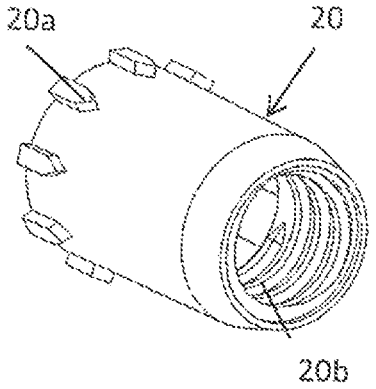
Figure 7G:
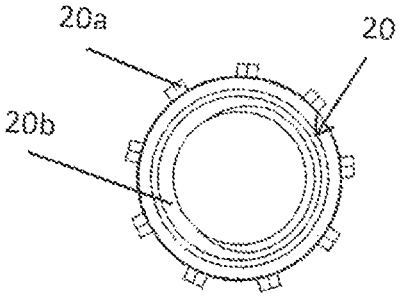
Figure 8A:
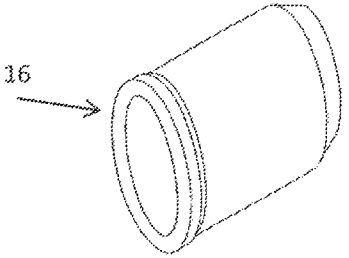
FIGS. 8*a* to 8*f* are illustrative diagrams showing a holding member as a part of the rotary advancing container shown in FIG. 1, FIG. 8*a* a perspective view from the front, FIG. 8*b* a view from the front, FIG. 8*c* a perspective view from the rear, FIG. 8*d* a front view, FIG. 8*e* a vertical section cut across a plane K1-K2 in FIG. 8*b* and FIG. 8*f* a view from the rear.
Figure 8C:
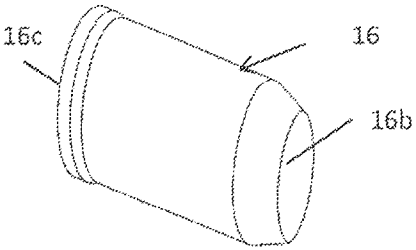
Figure 8B:
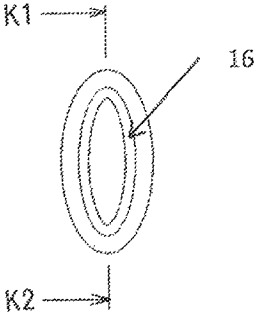
Figure 8D:
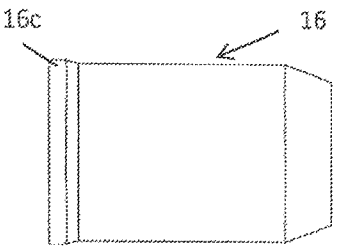
Figure 8F:
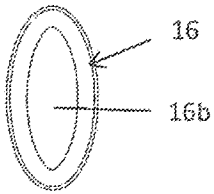
Figure 8E:
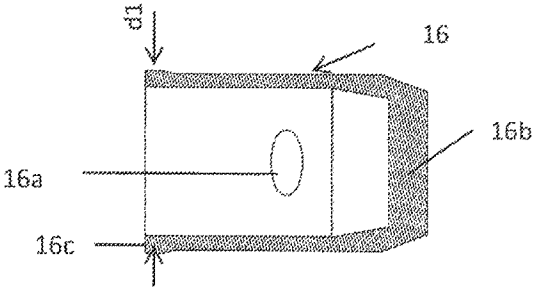
Figure 9B:
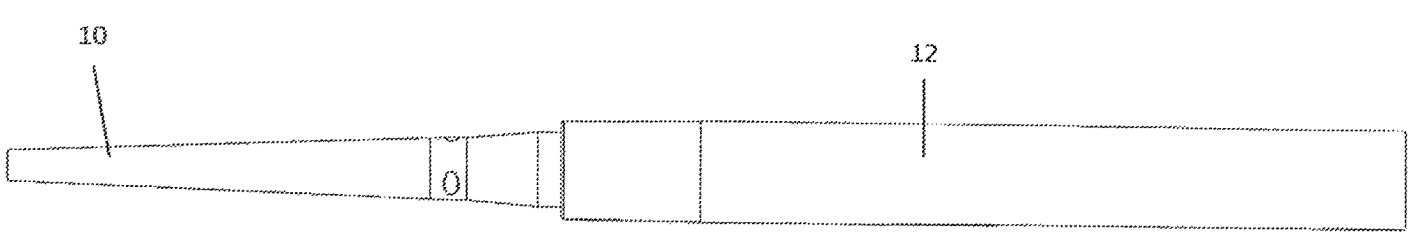
FIGS. 9*a* to 9*d* are illustrative diagrams showing a finished state of the rotary advancing container shown in FIG. 1, FIG. 9*a* a view from the front, FIG. 9*b* an external view, FIG. 9*c* a vertical section cut across a plane L1-L2 in FIG. 9*a* and FIG. 9*d* a vertical section cat across a plane M1-M2 in FIG. 9*a*, which is rotated 90° from FIG. 9*c*.
Figure 9C:
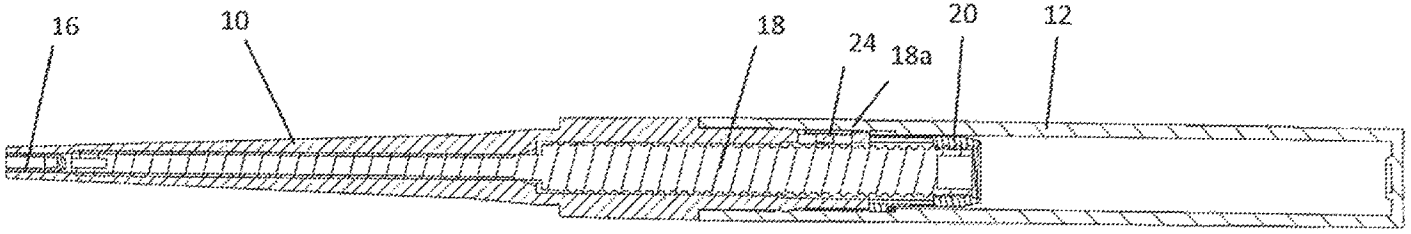
Figure 9D:
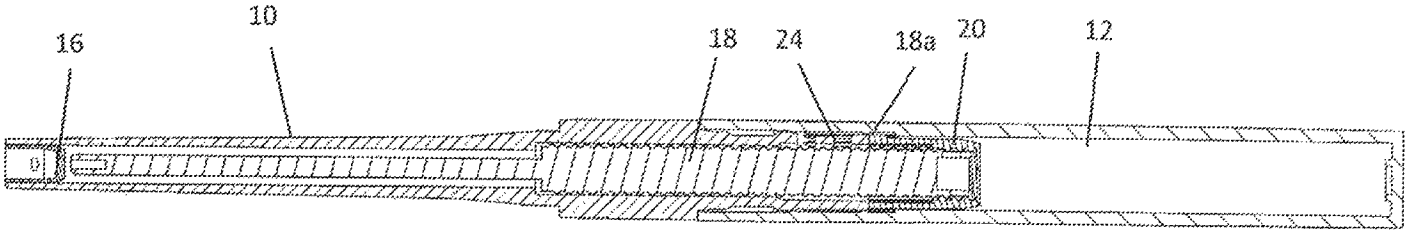
Figure 9A:
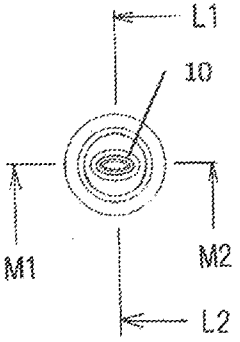

(2) The thread part 18*b* of the threaded rod 18 is formed with a male thread while the inner periphery of the threaded piece 20 is formed with a female thread 20*b* (FIGS. 7*e* to 7*g*). In the embodiment, the thread length of the female thread 20*b* is specified as snort as 2 to 3 mm, whereas the thread length of the male thread side is specified to be 30 to 40 mm (preferably, eight to ten times of the thread length of the female thread).

(3) The thread part in the rear end 18*c* of the thread rod 15 is lowered in height and the lightening hole 18*c*1 is formed from the rear end face, as shown in FIG. 6. At the limit of the thread rod advancement during using, the thread part lowered in height. In the thread rod rear end 13*c* flexes inward thanks to the lightening (hole 18*c*1) formed under the thread part so that the thread rotates idly without breaking the container, thus ma icing it possible to notify the user of the end of use. When the stick-like member 14 is a cosmetic, the holding member 16 reaches (is exposed from) the opening at the front end of the loading passage 10*a* at the end of use as shown in FIG. 9. As a result, the user can also visually confirm the end of use.

(4) The cylindrical part (the airtight portion 10*c* (FIGS. 4*d* to 4*f*) of the front barrel 10 that establishes sealed fitting with the cap 22 is formed by an interior peripheral wall having an uniform thickness, creating stable sealing quality and performance.

(5) The loading passage 10*a* (FIG. 4*f*) in the front barrel 10 is tapered from the mouth opening to the rear, with a slope angle of 0.5 to 2.0 degrees.

(6) The front barrel 10 is specified to have an elliptic cross-section in the range where the slope angle is 0.5 to 2.0 degrees. The piston as a sealing part to be fitted with that ellipse, namely the holding member 16 (FIG. 8) is specified so that its dimensions are marginally greater than the dimensions of the ellipse of the front barrel, whereby the holding member can slide in the direction to which the axis of the rotary advancing container extends and positively create sealed fitting with the interior surface of the front barrel 10.

(7) The cap 22 and the front barrel 10 each have a sealed fitting portion (sealing portion 22*b* (FIG. 3*d*) and airtight portion 10*c* (FIGS. 4*d*-4*f*). The sealing portion (airtight portion 10*c*) of the front barrel 10 has a cylindrical shape forming sealed fitting with an appropriate interface with the annular projection (sealing portion 22*b*) on the inner periphery of the cap 22.

As has been described heretofore, according to the rotary advancing container of the embodiment, it is possible to configure a rotary advancing container with a small number of components including a front barrel 10, rear barrel 12, holding mentor 16, stick-like member 14, threaded rod 13 and others.

The threaded rod 18 is screwed into the interior part of the rear barrel 12, and the front end of the threaded rod 18 has approximately the same shape with the stick-like member 14 while the rear half of the rod 18 is formed with a non-circular thread part 18*b*. Loading the material into the interior space of the front barrel 10 up to the holding member 16 makes it possible to create the stick-like member 14. As the rear barrel 12 is turned relative to the front barrel 10, the stick-like member 14 can be advanced as small a length as 0.01 to 0.2 (preferably around 0.05) mm by one click with a clicking sensation thanks to the ratchet part 24. Thus, the rotary advancing container can provide excellent effect in advancing stick-like member 14 with a simple structure.

The present invention should not be limited to the above embodiment. The various modifications can be made within the scope of the present invention. Instead of restricting the direction of rotation, the ratchet part may have a structure that permits reverse rotation.

INDUSTRIAL APPLICABILITY

The rotary advancing container of the present invent ion, without having restriction on its usage, can deal with solid makeup materials or products such as makeup eyebrow, eyeliner, lip liner cosmetics, writing implements such as color pencils, pencils and quasi-drugs aiming at moisturizing corners of the mouth and lips and the like, and can be appropriately used as rotary advancing containers for storing these.

DESCRIPTION OF REFERENCE NUMERALS

10 front barrel
10*a* leading passage

12 rear barrel
14 stick-like member (core)
16 holding member
18 threaded bar
20 threaded piece
24 ratchet part

What is claimed is:

1. A rotary advancing container comprising:

a cylindrical front barrel;

a cylindrical rear barrel arranged in a rear of the front barrel so as to be rotatable relative to the front barrel;

a holding member inserted inside the front barrel or the rear barrel to support a stick-shaped member; and, a threaded rod that is screwed into an interior part of the rear barrel, wherein the stick-shaped member having a non-circular shape is moved in an axial direction relative to the front barrel by rotating the front barrel relative to the rear barrel, a front end of the threaded rod is formed in approximately the same shape with the stick-shaped member, a rear side portion of the threaded rod has a non-circular shape and is formed with a thread, the holding member is configured to move the stick-shaped member forward when the threaded rod is actuated forward, and, the threaded rod is formed with a lightening hole in an interior of the rear end while the height of a rear part of the thread is lower than the height of a front part of the thread.

2. The rotary advancing container according to claim 1, wherein the thread of the threaded rod has an approximately circular section with a flat part formed thereon.

3. The rotary advancing container according to claim 1, wherein the front barrel has a core loading part of an interior space, into which the stick-shaped member is loaded while an opening at a front end of the core loading part is formed so as to have a greater cross-section than that at a rear end of the core loading part.

4. The rotary advancing container according to claim 1, wherein the front barrel has a core loading part of an interior space, into which the stick-shaped member is loaded and a material is loaded into the core loading part to form the stick-shaped member in a state where the threaded rod and the holding member are retracted rearwards.

5. The rotary advancing container according to claim 1, wherein the holding member is configured to seal against an inner surface formed by the front barrel.

6. The rotary advancing container according to claim 1, wherein the threaded rod is configured to urge the holding member only in the forward direction, such that when the threaded rod is actuated rearward the threaded rod does not urge the holding member rearward.

7. The rotary advancing container according to claim 1, wherein the lightening hole is configured to allow the rear end of the threaded rod to flex inward, when the threaded rod is at its limit of advancement, such that the cylindrical rear barrel rotates idly relative to the threaded rod.

* * * * *